US007385798B2

(12) United States Patent
Warren et al.

(10) Patent No.: US 7,385,798 B2
(45) Date of Patent: Jun. 10, 2008

(54) MULTIPLE SENSOR FEEDBACK FOR CONTROLLING MULTIPLE IONIZERS

(75) Inventors: Brian Warren, Reno, CA (US); Edward Oldynski, Martinez, CA (US); Scott Gehlke, Berkeley, CA (US)

(73) Assignee: MKS Instruments, Alameda, CA (US)

( * ) Notice: Subject to any disclaimer, the term of this patent is extended or adjusted under 35 U.S.C. 154(b) by 31 days.

(21) Appl. No.: 11/651,120

(22) Filed: Jan. 8, 2007

(65) Prior Publication Data

US 2007/0159765 A1 Jul. 12, 2007

Related U.S. Application Data

(60) Provisional application No. 60/758,434, filed on Jan. 11, 2006.

(51) Int. Cl.
*H02H 1/00* (2006.01)

(52) U.S. Cl. ..... 361/212

(58) Field of Classification Search ..... 361/212, 361/213

See application file for complete search history.

(56) References Cited

U.S. PATENT DOCUMENTS

| | | | | |
|---|---|---|---|---|
| 6,798,637 | B1 * | 9/2004 | Graham | 361/230 |
| 6,826,030 | B2 * | 11/2004 | Gorczyca et al. | 361/212 |
| 6,850,403 | B1 * | 2/2005 | Gefter et al. | 361/230 |
| 2006/0109603 | A1 * | 5/2006 | Kraz et al. | 361/220 |

* cited by examiner

*Primary Examiner*—Michael J Sherry
*Assistant Examiner*—Christopher J Clark
(74) *Attorney, Agent, or Firm*—John Menear

(57) ABSTRACT

A feedback architecture for ionizers that allows simultaneous adjustment of positive and negative ionizer power supplies. Balance and swing data are fed back to the ionizer through an intermediate module, which permits an extra level of signal processing. Swing information is returned to both power supplies in negative feedback mode. If swing is too high, both power supplies lower output. Balance is fed back in both negative and positive feedback mode. This architecture is compatible with multiple sensors and multiple ionizers.

37 Claims, 5 Drawing Sheets

Volts

Time

MULTIPLE SENSOR FEEDBACK FOR CONTROLLING MULTIPLE IONIZERS

CROSS-REFERENCE TO RELATED APPLICATIONS

This application claims priority to U.S. Provisional Application No. 60/758,434 filed Jan. 11, 2006 entitled "Multiple Sensor Feedback for Controlling Multiple Ionizers".

STATEMENT REGARDING FEDERALLY SPONSORED RESEARCH

Not Applicable

REFERENCE TO A MICROFICHE APPENDIX

Not Applicable

BACKGROUND OF THE INVENTION

1. Field of the Invention

This invention relates to ionizers, which are designed to remove or minimize static charge accumulation. Ionizers remove static charge by generating air ions and delivering those air ions to a charged target.

One type of ionizer uses corona electrodes to produce air ions. During operation, debris can build up on the corona electrodes and change the ionizer performance. Performance parameters include balance, swing, and discharge time.

Sensor feedback to the ionizer is desirable for two reasons. The first reason is maintaining the ionizer's balance, swing, and discharge time within predetermined limits. The second reason is notifying the user when balance and discharge time breach the predetermined limits.

In a conventional closed loop feedback system, one sensor is connected to one ionizer. The one-to-one correspondence is a simple case, and feedback signals can be generated within the sensor itself.

The current invention uses novel feedback architecture and signal processing to allow individual or multiple sensors to control individual or multiple ionizers. An intermediate module receives raw signals from one or more sensors, and creates the best feedback instruction. In turn, the best feedback signal is forwarded to one or more ionizers.

The position of each sensor is considered when the intermediate module creates the best feedback signal.

2. Description Of Related Art

Ionizers remove static charge by ionizing air molecules, and delivering those generated air ions to a charged target. The air ions are most commonly created by high voltage applied to corona electrodes. Positive air ions neutralize negative static charges, and negative air ions neutralize positive static charges.

From a performance view, ionizers are defined by balance, discharge time, and swing.

Balance is a measure of closeness to zero volts. After the initial charge is removed from a target, that target would ideally equilibrate at zero volts from ground. In practice, the target equilibrates near zero volts from ground, but seldom exactly at zero volts.

Balance is normally specified as a range around zero. For example, ionizer balance may be specified as −5 volts to +5 volts. If voltages between −5 and +5 volts do not affect products handled within the workstation, the products can be handled safely. But if voltages between −2 and +2 volts affect products handled within the workstation, an ionizer with a tighter balance specification is appropriate.

Discharge time is a measure of how fast a given level of charge can be removed from a charged target. Low discharge times are better than high discharge times. For example, an ionizer with a discharge time of 3 seconds could be applied to a moving charged target that only remains under the ionizer for 3 seconds.

Swing is the peak-to-peak voltage that an AC or pulsed DC ionizer produces at the target. Static sensitive products can be damaged by high swing, even though the average balance is near zero.

Historically, ionizer feedback has consisted of one sensor connected directly to one ionizer. Although this is useful, positional errors are inherent. The single sensor does not represent the ionizer's performance everywhere within the work zone. Balance may be positive in one location, and negative in a second location. Discharge time and swing also vary with location.

A single sensor also reflects grounded objects in the vicinity. For example, a grounded metal object close to a sensor could skew the sensor's measurements. If the metal object preferentially absorbs positive air ions, the sensor will report a negative balance. In addition, the negative discharge time will increase.

Swing is reduced when the metal object reduces the density of both positive and negative air ions.

Prior art sensors that are connected directly to an ionizer also miss the opportunity to filter out irregular perturbations. The reason is that the prior art sensors are based on average analog responses, and the perturbation is lost in the averaging. Consider a grounded robot arm that travels between the ionizer and the sensor. When the robot arm is directly under the ionizer, the number of air ions that reach the sensor is reduced. Simultaneously, the balance of air ions may shift.

With an intermediate digital module, the opportunity would exist to correct for positional biases, correct for positional variances, and correct for temporal disturbances. Although no prior art systems have pursued this architecture, there is a need.

BRIEF SUMMARY OF THE INVENTION

The present invention incorporates an intermediate module into the ionizer feedback architecture. The intermediate module is positioned between the feedback sensor(s) and the ionizer(s).

Sensors provide the information from which feedback signals are generated. But, for this invention, sensors are not connected directly to the ionizers. Instead, the sensors are connected to an intermediate module. Feedback signals are created within the intermediate module.

The intermediate module creates several capabilities that are lacking in the prior art. The underlying reason is that the intermediate module introduces an additional level of data processing.

In one preferred system configuration, the intermediate module links one sensor to one-or-more ionizers. Linkage means that the sensors within the linked group control the ionizers within the linked group. In a second preferred configuration, two sensors are used. Each of the two sensors is linked with a non-overlapping group of one or more ionizers, and the intermediate module centrally controls two feedback loops.

The inventive concept allows linkage among large numbers of sensors and large numbers of ionizers.

The inventive concept also allows intentional interaction among linked groups. In this scenario, multiple sensor inputs are combined to create a geographically representative view of the ionizer's performance within the workspace. When the intermediate module generates its feedback signal, the ionizer's performance at several locations has been considered.

Multiple ionizers can be addressed by the feedback. In one scenario, not all ionizers receive the same feedback signal. Each ionizer is adjusted individually to provide the best overall static charge protection.

An intermediate module allows for weighed priorities when generating the feedback signal. For instance, accurate balance directly at a wafer pre-aligner station may be more important than accurate balance close to a side door. If the static sensitive product never gets closer than 12 inches to the side door, the balance condition at the side door has minimal importance. The multiple ionizers can be adjusted to reflect this priority.

In an alternate scenario, the goal might be the highest level of uniformity when considering all locations within the workspace.

A unique feature of the invented concept involves the category of sensor information upon which feedback is based. Prior art systems create feedback adjustments from balance, discharge time, ion current, and return-current-to-ground. The current invention creates feedback signals from balance and swing (peak-to-peak voltage). Utilizing swing and balance to generate feedback adjustments is a significant departure from the prior art.

Other unique features of the invented concept are (1) the direction of feedback for each ionizer power supply, and (2) a requirement for two power supplies in each ionizer (one positive high voltage power supply and one negative high voltage power supply).

The directions (positive or negative) of feedback are:

(1) Swing differences from a swing set-point are negatively fed back to the ionizer's positive high voltage power supply and to the ionizer's negative high voltage power supply.

(2) Balance differences from a balance set-point are positively fed back to the ionizer's negative high voltage power supply.

(3) Balance differences from a balance set-point are negatively fed back to the ionizer's positive high voltage power supply.

Additionally, swing and balance feedback are overlaid, and the updates are made simultaneously. This provides smooth, balanced, and monotonic responses.

The intermediate module also provides the opportunity for digital filtering. A short-term perturbation can be recognized and ignored. The result is a more accurate feedback signal that reflects the long-term status of the ionizer.

Objects of the invention include (1) providing a feedback architecture that can address multiple sensors and multiple ionizers, (2) providing an intermediate module for generation of feedback signals, (3) providing an additional level of data processing prior to generating a feedback signal, (4) providing weighting factors that reflect ionization priorities, (5) generating feedback signals that vary among ionizers, and (6) using swing (peak-to-peak voltage) to generate feedback.

DETAILED DESCRIPTION OF THE INVENTION

Figure 1:
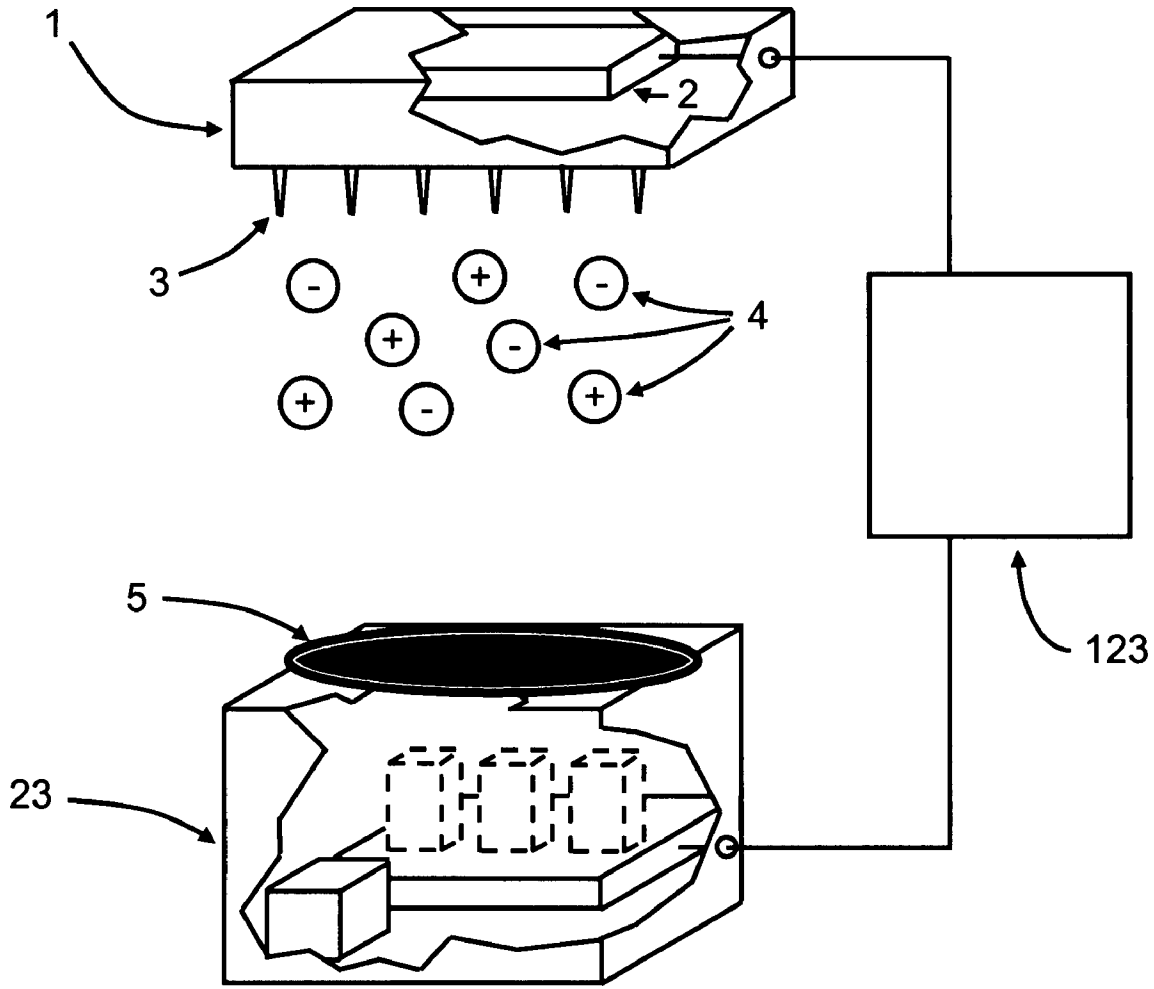
FIG. 1 is a schematic that shows a sensor receiving air ions from one or more ionizers. Balance signals and swing signals and are fed back to two ionizer power supplies through an intermediate module

FIG. 1 shows one or more ionizers 1 and a sensor 23 operating in a feedback loop through an intermediate module 123. Two high voltage power supplies 2 (only one is shown in FIG. 1) inside the ionizer place a high voltage on the corona electrodes 3 to produce air ions 4.

A sensor 23 collects the air ions 4 which reach the sensor plate 5. These air ions 4 contain the information on both balance and swing, but the sensor plate 5 alone does not separate the swing signal from the balance signal. In the embodiment shown, the sensor 23 is combined with the intermediate module 123, and the balance signal is separated from the swing signal.

Figure 2:
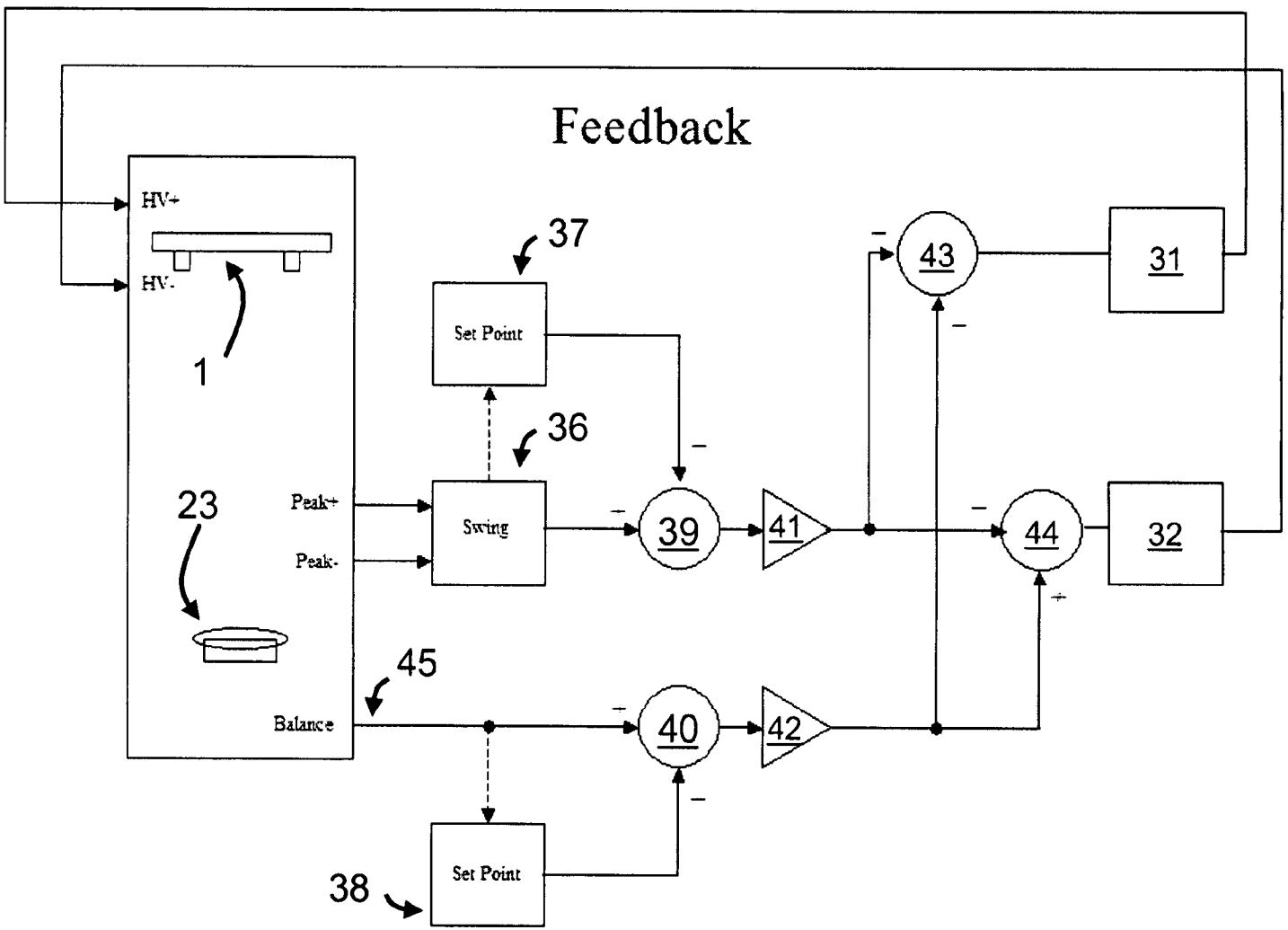
FIG. 2 is a schematic that shows an invented feedback circuit. Information from the sensor is segmented into a balance signal and a swing signal, which are compared to set points. Differences from set points are used to generate feedback to the two ionizer power supplies.
Figure 3:
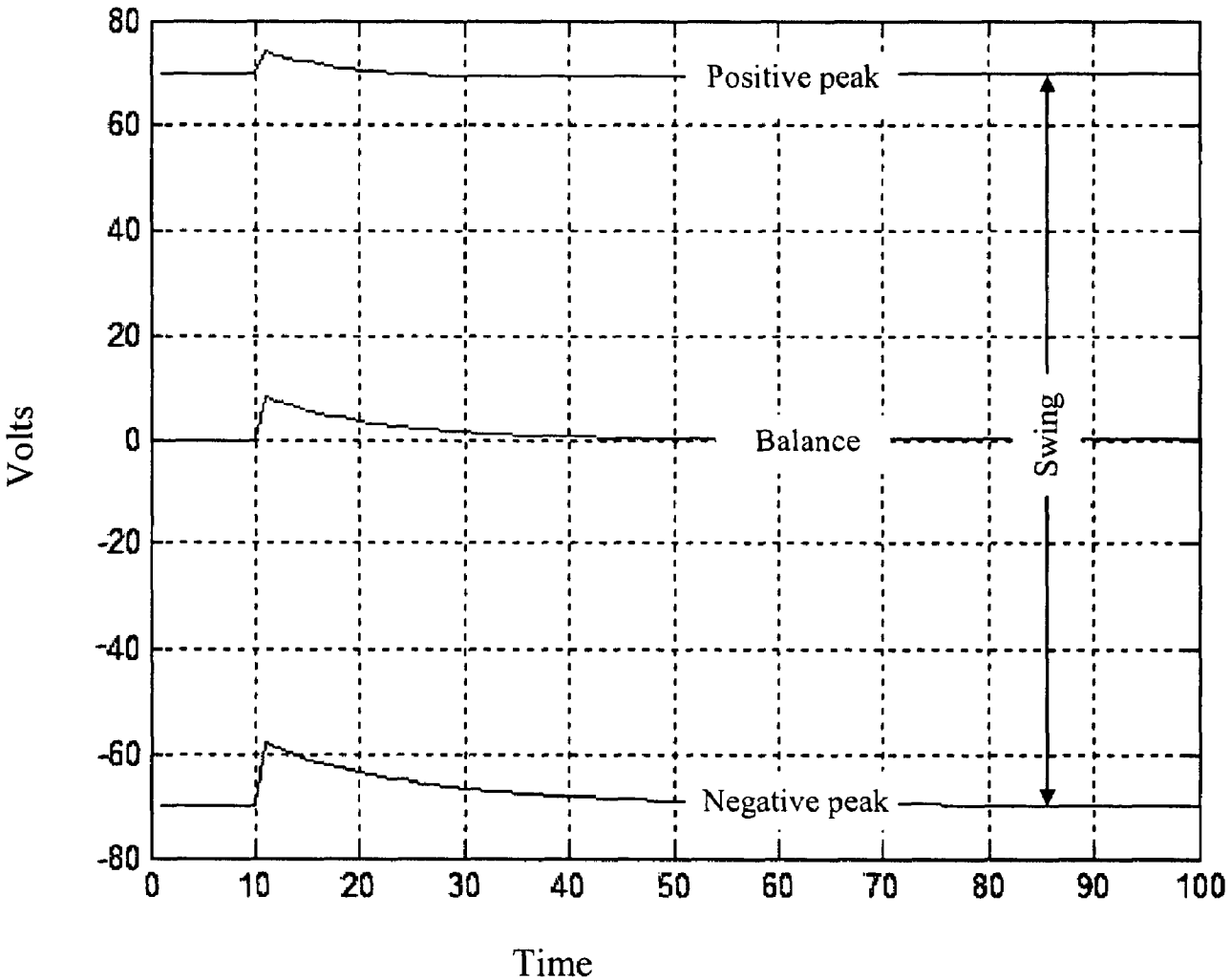
FIG. 3 shows prototype data for a step perturbation of both balance and swing. The top line shows positive peak; the middle line shows balance; and the bottom line shows negative peak. A perturbation was applied at time unit 10. Both swing and balance settled to within 90% of their pre-perturbation values with 40 time adjustment units.

As shown in FIG. 2, the positive HV register 31 and the negative HV register 32 contain the positive HV feedback value and the negative HV feedback value, which are forwarded to the two power supplies 2 within the ionizer 1.

Real-time swing signal 36 is the difference between positive and negative peak measurements for the most recent sampling. Real-time balance signal 45 is the non-alternating component of the total sensor 23 signal.

Upon startup, default values are used by the positive HV register 31 and the negative HV register 32 to establish the ionizer's initial performance. At this time feedback has not been initiated (feedback disabled). During this "feedback disabled" period, the positive input summing block 43 and the negative input summing block 44 do not update the positive HV register 31 and the negative HV register 32.

When feedback is enabled, the real-time swing signal 36 is copied to the swing set-point register 37. Similarly, the real-time balance signal 45 is copied to the balance set-point register 38. The swing set-point register 37 and the balance set-point register 38 are not updated again until the feedback is disabled, then subsequently re-enabled.

When feedback is enabled, the difference between the swing set-point register 37 and the real-time swing signal 36 is zero, as calculated by the swing summing block 39. Similarly, the difference between the balance set-point register 38 and the real-time balance signal 45 is zero, as calculated by the balance summing block 40.

Additionally, at the time that feedback is enabled, the zero balances at the swing summing block 39 and the balance summing block 40, propagate through the remainder of the circuit to the positive HV register 31 and the negative HV register 32. Zero contribution is added to both the positive HV register 31 and the negative HV register 32.

At a later time, when dirty or worn corona electrodes in an ionizer 1 change the ionizer's 1 performance, the real-time swing signal 36 will differ from the swing set-point register 37, and the value of the swing summing block 39 will be non-zero. Similarly, the real-time balance signal 45 will differ from the balance set-point register 38, and the value of the balance summing block 40 will be non-zero.

The value from the balance summing block 40 goes through a balance gain stage 42, which controls the speed of the response to a change in balance. The output of the balance gain stage 42 integrated into the next update of the positive HV register 31 and the negative HV register 32. In one preferred embodiment, the balance gain stage 42 is set to 0.00025 for a particular ion sensor. This produced the responses shown in FIGS. 4 and 5.

The output from the balance gain stage 42 is propagated through positive input summing block 43 and through negative input summing block 44. The output from the balance gain stage 42 is negatively applied to the positive input summing block 43 and is positively applied to the negative input summing block 44. Therefore, if the balance drops negatively, the output from the balance gain stage 42 will go negative, which will increase the subsequent value of positive HV register 31 and reduce the subsequent value of negative HV register 32.

As positive HV register 31 is increased and the negative HV register 32 is decreased, the real-time balance signal 45 will subsequently change in the positive direction, and the output of the balance summing block 40 will decrease exponentially toward zero. This will reduce future adjustments to the positive HV register 31 and to the negative HV register 32, tending toward zero.

Similarly, changes in the real-time swing signal 36 generate non-zero values from the swing gain stage 41. But conversely to the balance, the swing gain stage 41 will be subtracted from both the positive HV register 31 and the negative HV register 32. For example, if the real-time swing signal 36 drops, the output of the swing gain stage 41 will go negative, and both the positive HV register 31 and the negative HV register 32 will increase. In turn, real-time swing signal 36 will return to the level in the swing set-point register 37.

In summary, the new HV levels are represented by the following formulae, calculated at each update period.

$$HV\text{Level}+=HV\text{Level}+-\text{GainSwing}(\text{Swing}-\text{SwingSet-point})-\text{GainBalance}(\text{Balance}-\text{BalanceSetpoint})$$

$$HV\text{Level}-=HV\text{Level}--\text{GainSwing}(\text{Swing}-\text{SwingSet-point})+\text{GainBalance}(\text{Balance}-\text{BalanceSetpoint})$$

Figure 4:
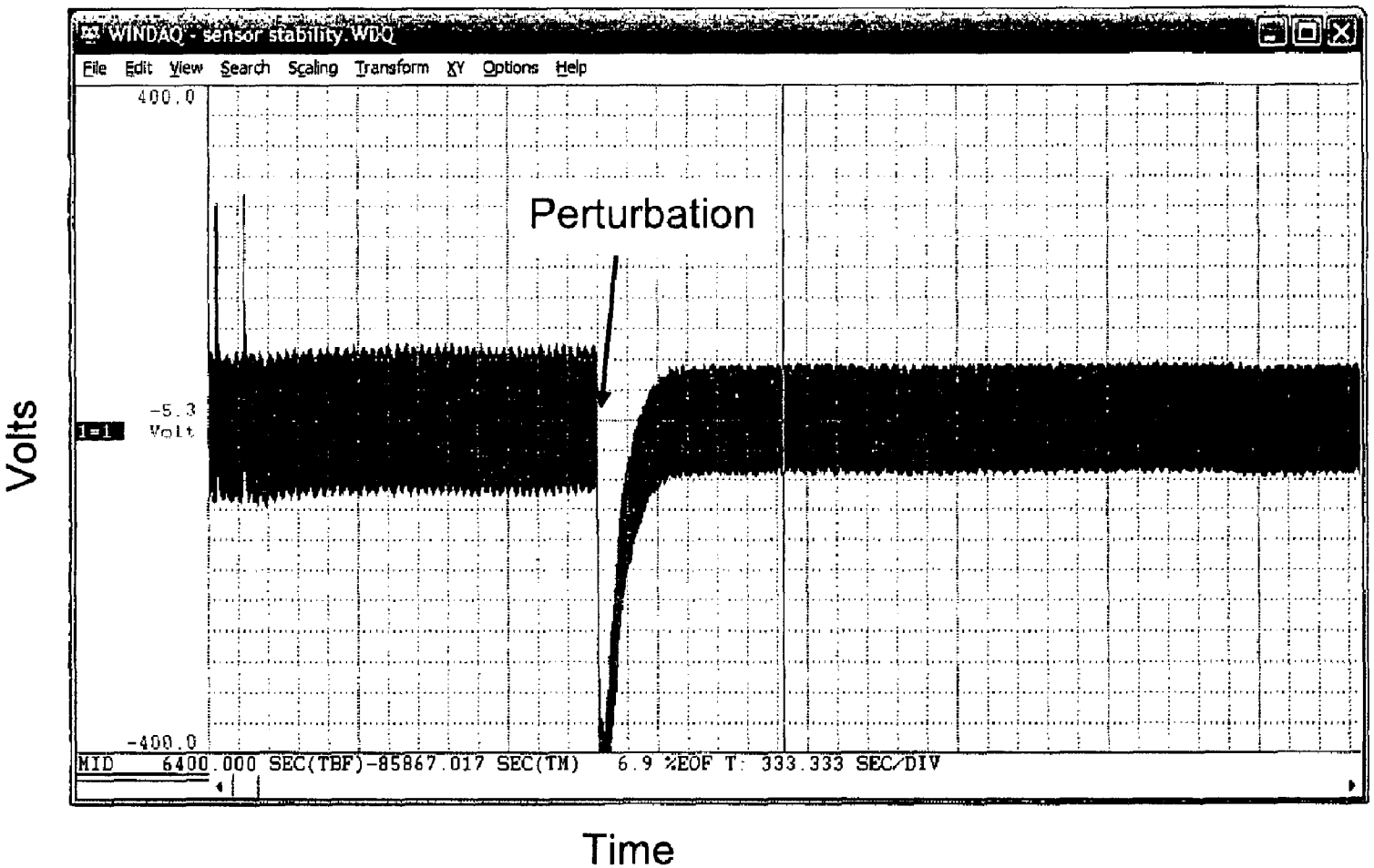
FIG. 4 shows the effects of the feedback loop on balance performance as measured on a reference CPM. A perturbation was purposely introduced.

FIG. 4 shows the effects of the feedback loop on balance performance as measured on a reference CPM. The imbalance perturbation was introduced by grounding a piece of copper tape near one of the negative corona electrodes. After dozens of minutes, the feedback loop compensates for the perturbation, and returns the balance to initial levels.

Figure 5:
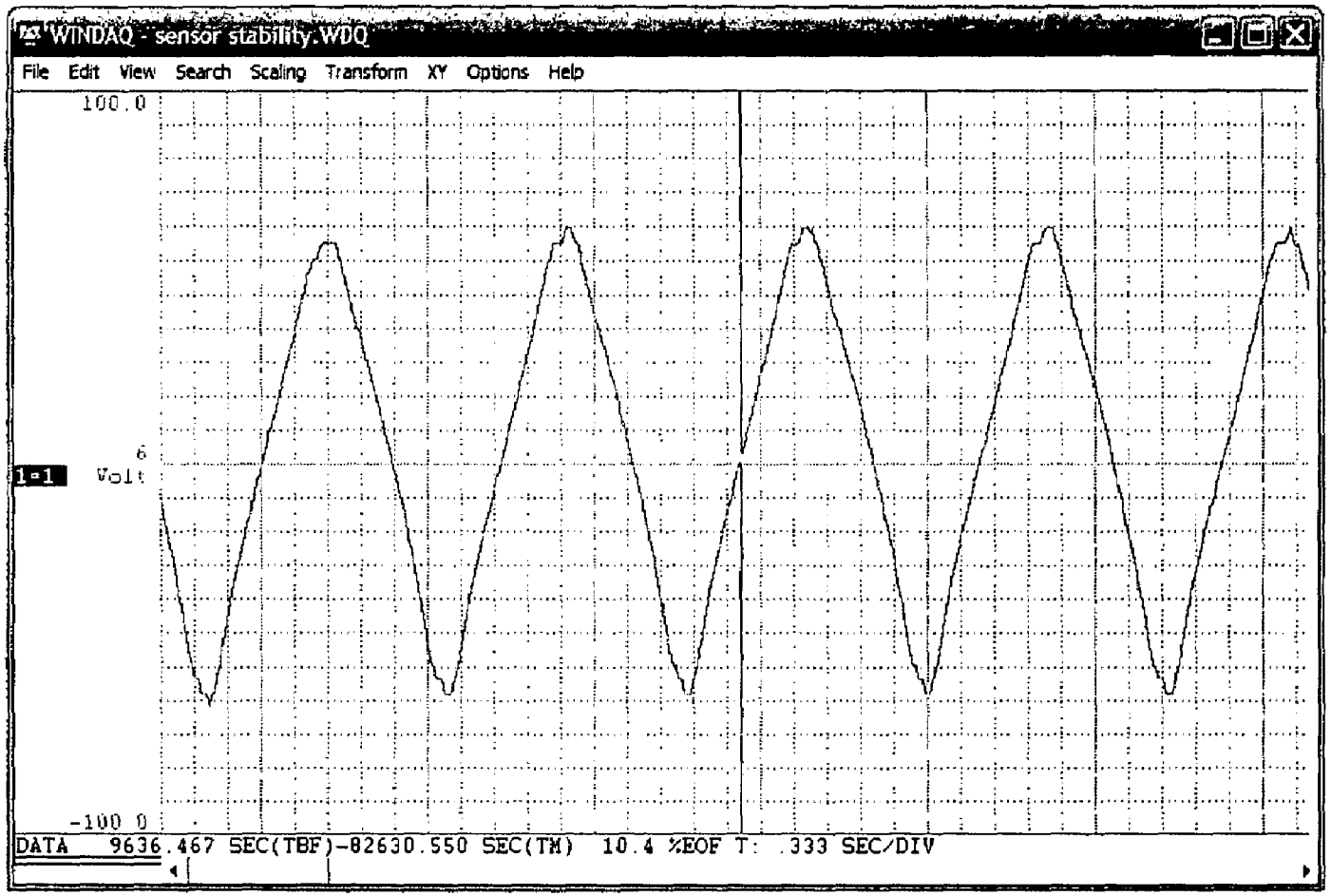
FIG. 5 shows higher time resolution of FIG. 4 after the perturbation.

FIG. 5 shows higher time resolution of FIG. 4 after the perturbation. The feedback loop compensated for an extraordinarily large artificial imbalance.

The invention claimed is:

1. A method of monitoring and adjusting ionizers that contain a positive high voltage power supply and a negative high voltage power supply comprising:

(a) receiving non-separated real-time balance signals and real-time swing signals from a sensor;

(b) separating said real-time balance signal from said real-time swing signal with an intermediate module;

(c) comparing said real-time swing signal to a swing set-point register, and calculating a swing difference;

(d) comparing said real-time balance signal to a balance set-point register, and calculating a balance difference;

(e) applying said swing difference as negative feedback to said positive high voltage power supply and to said negative high voltage power supply;

(f) applying said balance difference as negative feedback to said positive high voltage power supply; and (g) applying said balance difference as positive feedback to said negative high voltage power supply.

2. The method of claim 1 where said swing difference is modified by a swing gain stage prior to the applying step (e).

3. The method of claim 2 where said swing gain stage affects the response time required to restore normal operation following a swing perturbation.

4. The method of claim 1 where said balance difference is modified by a balance gain stage prior to the applying steps (f) and (g).

5. The method of claim 4 where the balance gain stage affects the response time required to restore normal operation following a balance perturbation.

6. The method of claim 1 where said sensor has a low input impedance.

7. The method of claim 1 where said positive high voltage power supply and said negative high voltage power supply may not exceed a predetermined voltage level.

8. The method of claim 7 where an alarm is activated if said predetermined voltage level is exceeded.

9. The method of claim 1 where said swing set-point register and said balance set-point register are set at the time feedback is enabled.

10. The method of claim 1 where said real-time swing signal is defined as the peak-to-peak voltage produced by said sensor.

11. A method of monitoring and controlling an ionizer comprising:

(a) measuring both real-time swing signals and real-time balance signals with one or more sensors;

(b) forwarding said real-time swing signal and said real-time balance signal to an intermediate module;

(c) generating two feedback signals within said intermediate module, where each of the said two feedback signals comprise, a balance difference, and a swing difference; and (d) adjusting a positive high voltage power supply and a negative high voltage power supply that are components of said ionizer with said two feedback signals.

12. The method of claim 11 where said balance difference is defined as the difference between said real-time balance signal and a value stored in a balance set-point register.

13. The method of claim 11 where said swing difference is defined as the difference between said real-time swing signal and a value stored in a swing set-point register.

14. The method of claim 11 where said swing difference is input as a negative feedback to said positive high voltage power supply and to said negative high voltage power supply in adjusting step (d).

15. The method of claim 11 where said balance difference is input as negative feedback to said positive high voltage power supply.

16. The method of claim 11 where said balance difference is input as positive feedback to said negative high voltage power supply.

17. The method of claim 11 where said real-time swing signal is defined as the peak-to-peak voltage produced by said sensor.

18. The method of claim 11 where said one or more sensors are located within a work station.

19. The method of claim 11 where said intermediate module is positioned between said sensors and said ionizer.

20. The method of claim 11 where said generating step (c) employs a swing summing block and a balance summing block to calculate said swing difference and said balance difference, respectively.

21. The method of claim 11 where said two feedback signals are propagated through a positive HV register and a negative HV register.

22. The method of claim 11 where said generating step (c) employs a swing gain stage and a balance gain stage.

23. An intermediate module which is used to convert sensor data to ionizer feedback signals comprising:

one or more swing input ports which receive real-time swing signals;

one or more balance input ports which receive real-time balance signals;

one or more balance summing blocks to detect changes in said real-time balance from a balance set-point register;

one or more swing summing blocks to detect changes in said real-time swing from a swing set-point;

one or more positive HV registers that send feedback to a positive high voltage power supply, wherein said positive high voltage power supply is a component of said ionizer;

one or more negative HV registers that send feedback to a negative high voltage power supply, wherein said negative high voltage power supply is a component of said ionizer.

24. The intermediate module of claim 23 where said balance summing block calculates a balance difference.

25. The intermediate module of claim 24 where said balance difference is the difference between said real-time balance signal and said balance set-point register.

26. The intermediate module of claim 23 where said swing summing block calculates a swing difference.

27. The intermediate module of claim 26 where said swing difference is the difference between said real-time swing signal and said swing set-point register.

28. The intermediate module of claim 23 further comprising a swing gain stage or a balance gain stage.

29. The intermediate module of claim 23 further comprising a positive input summing block and a negative input summing block.

30. The intermediate module of claim 29 where said positive input summing block combines negative swing feedback and negative balance feedback.

31. The intermediate module of claim 29 where said negative input summing block combines negative swing feedback and positive balance feedback.

32. The intermediate module of claim 29 where said positive input summing block updates said positive HV register and said negative input summing block updates said negative HV register.

33. The intermediate module of claim 23 where said intermediate module is configured to interface with multiple sensors and multiple ionizers.

34. The intermediate module of claim 33 where a predetermined subset of said multiple sensors is linked to a predetermined subset of said multiple ionizers.

35. The intermediate module of claim 33 where said real-time swing signals and said real-time balance signals from said multiple sensors are combined into weighted feedback signals.

36. The intermediate module of claim 35 where said weighted feedback signals provide adjustments that are not the same for all ionizers.

37. The intermediate module of claim 23 further comprising a digital filter to remove irregular temporal perturbations.

* * * * *